US005133491A

United States Patent [19]

Correll et al.

[11] Patent Number: 5,133,491

[45] Date of Patent: Jul. 28, 1992

[54] SUBSTRATE BREAKER

[75] Inventors: Thomas R. Correll, Harrisburg; Richard K. Dennis, Etters, both of Pa.

[73] Assignee: Die Tech, Inc., York Haven, Pa.

[21] Appl. No.: 630,873

[22] Filed: Dec. 20, 1990

[51] Int. Cl.[5] ..... B26F 3/00

[52] U.S. Cl. ..... 225/1; 225/2; 225/4; 225/96.5; 225/97; 225/103

[58] Field of Search ..... 225/1, 2, 4, 96.5, 97, 225/103, 105, 96

[56] References Cited

U.S. PATENT DOCUMENTS

| | | | |
|---|---|---|---|
| 3,149,765 | 9/1964 | Horning et al. | 225/2 X |
| 3,507,426 | 4/1970 | Bielen et al. | 225/2 |
| 3,562,057 | 2/1971 | McAlister et al. | 156/300 |
| 3,788,533 | 1/1974 | Allen | 225/96.5 |
| 3,790,051 | 2/1974 | Moore | 225/1 |
| 4,068,788 | 1/1978 | Gubitose et al. | 225/1 |
| 4,088,255 | 5/1978 | DeTorre | 225/98 |
| 4,235,357 | 11/1980 | Young | 225/1 |
| 4,306,672 | 12/1981 | Johannes | 225/97 |
| 4,646,954 | 3/1987 | Happ | 225/2 |
| 4,646,955 | 3/1987 | Garrick et al. | 225/96.5 X |

*Primary Examiner*—Frank T. Yost
*Assistant Examiner*—Eugenia A. Jones
*Attorney, Agent, or Firm*—Thomas Hooker

[57] ABSTRACT

A substrate breaker positively feeds substrate plates to a stick breaker where the sticks are broken from the plate. The sticks are fed upwardly to an elevated chip breaker where chips are broken from the sticks.

20 Claims, 5 Drawing Sheets

SUBSTRATE BREAKER

FIELD OF THE INVENTION

The invention relates to apparatus and methods for breaking prescribed ceramic substrate plates into individual substrate chips.

DESCRIPTION OF THE PRIOR ART

Chips are manufactured using large rectangular ceramic plates with circuit elements and contact pads mounted on the plate in a rectangular pattern and with a rectangular grid of score lines formed in the plate defining edges of individual chips. The plate is broken along the score lines to individual rectangular chips from the plate. The score lines are conventionally formed by stamping or laser drilling a series of small holes partially through the thickness of the plate. The large ceramic plates are commonly square, measure from two to five inches on a side and may include as many as 300 or more chips per plate.

Individual chips are formed by breaking the plate along the pre-weakened score lines. Volume production require that the chips be broken from the plates at a high rate with very accurate breaks along the score lines. This is difficult because of the fragility of the ceramic plate and because breaking of the ceramic produces ceramic dust and shards. In conventional substrate breaking machines, the highly abrasive ceramic dirt collects in the feed and breaking tooling resulting in accelerated wear, increasing inaccurate chip breaks, joints, equipment stoppage and possible machine failure.

Conventional substrate breakers gravity feed ceramic plates down hill to a breaking station along a feed path defined by a pair of feed grooves engaging the edges of the plates. At this station the lead row of chips, or stick, is extended outwardly beyond the ends of the grooves. A tool is brought into contact with the unsupported remote end of the cantilevered stick to hammer the stick out of the plane of the plate and break the stick from the remainder of the plate. The broken stick then falls free from the remainder of the plate and is fed laterally so that the lead chip in the stick is extended unsupported beyond the end of a second feed path. A second tool is then brought down on the free end of the cantilevered chip to break the chip from the remainder of the stick. The freed chip then falls down onto a surface and is fed away for subsequent processing and attachment to a circuit member.

Roughness in the edges of the plates and sticks also harms the machine. The roughness prevents the plates and sticks from falling freely to the stick break and chip break stations. Jamming requires an operator to stop the entire manufacturing operation in order to free the jam.

The downhill gravity feed used in the conventional chip breaker assures that dirt and the ceramic dust formed by chip breaking collects in the tracks and moves down the tracks with the plate to the stick break station. The debris wears in the tracks requiring replacement of the tracks.

Further, the debris is collected at the stick break station together with the dust inevitably formed during breaking of the sticks away from the remainder of the plate. This debris falls with the freed sticks to the chip break station. The debris wears the machine tooling coming into contact with the stick and the individual chips. Wear reduces the useful life of the apparatus and causes production shut downs.

SUMMARY OF THE INVENTION

The disclosed substrate breaker positively feeds tilted substrate plates from an initial loading position horizontally to a stick breaking position where the lead row of chips or stick is broken away from the plate. Ceramic debris and shards formed during the break or carried with the plate to the breaking position gravity fall away from the stick, the work area and feed path to reduce wear and assure reliable operation.

The stick is broken away from the plate by extending the lead end of the stick into a fixed pocket, supporting the stick and then rotating the plate feed path and plate down through an angle to break the stick from the remainder of the plate. In this way, the stick is accurately located and supported and broken at the break line formed in the plate so that a sharp, neat break is formed accurately at the prescribed line in the plate. An accurate break assures the dimensional integrity of the chips and reduces ceramic dust and shards formed during the break. The break surfaces open to allow debris to fall away.

The plate is fed to the stick break station horizontally along a 15-degree tilted plane so that the stick, when broken away from the plate, extends upwardly at a 15-degree angle. This stick is then fed upwardly along a 15-degree plane to successively position lead chips in the pocket of an individual chip breaker located at the top of the substrate breaker. During initial feeding of the stick the edge of the remaining plate forms a guide to pilot the lead end of the stick into a feed path extending up to the chip breaker. Following feeding of each chip into the chip breaker the chip breaker is rotated down 15-degrees to a horizontal position and accurately breaks the supported and located lead chip from the remainder of the stick. Feeding of the chip into the pocket of the chip breaker assures that a sharp neat break occurs at the prescribed line formed across the stick with minimum ceramic dust or shards. The debris inevitably formed during the breaking of the chip away from the stick gravity falls down from the chip breaker to minimize abrasive dust moved with the chip in the breaker. Individual chips are broken from the stick at the top of the machine in order to permit debris and shards to fall away from the chip.

The chips broken away from the stick are in a horizontal position suitable for lateral movement to a checking station where the dimensions and other properties of the chips are checked prior to attachment of legs and mounting of the chips on a circuit board or other circuit element.

In contrast to conventional substrate breakers, the disclosed breaker positively moves and holds the plate, sticks and chips during breaking. Ceramic debris inherent in the breaking operation to gravity falls away from the break sites and out of the path of movement for the plate, sticks and chips. The ability to break the plates at the score lines minimizes hooks and roughness in the break edges which, if present, increase wear on the tooling and could cause jams. Plates and sticks are positively fed to the respective breaking stations thereby preventing that gravity hangups of the type experienced in conventional breaking machines.

The disclosed substrate breaker may be used singly to form individual accurately broken chips at a rate of approximately 3,000 chips per hour. Alternatively, a pair of like disclosed substrate breakers, one the mirror image of the other, may be mounted together and fed from a single source of substrate plates to provide a total output of as many as 6,000 accurately broken chips per hour.

Other objects and features of the invention will become apparent as the description proceeds, especially when taken in conjunction with the accompanying drawings illustrating the invention, of which there are five sheets and one embodiment.

DESCRIPTION OF THE PREFERRED EMBODIMENT

Figure 1:
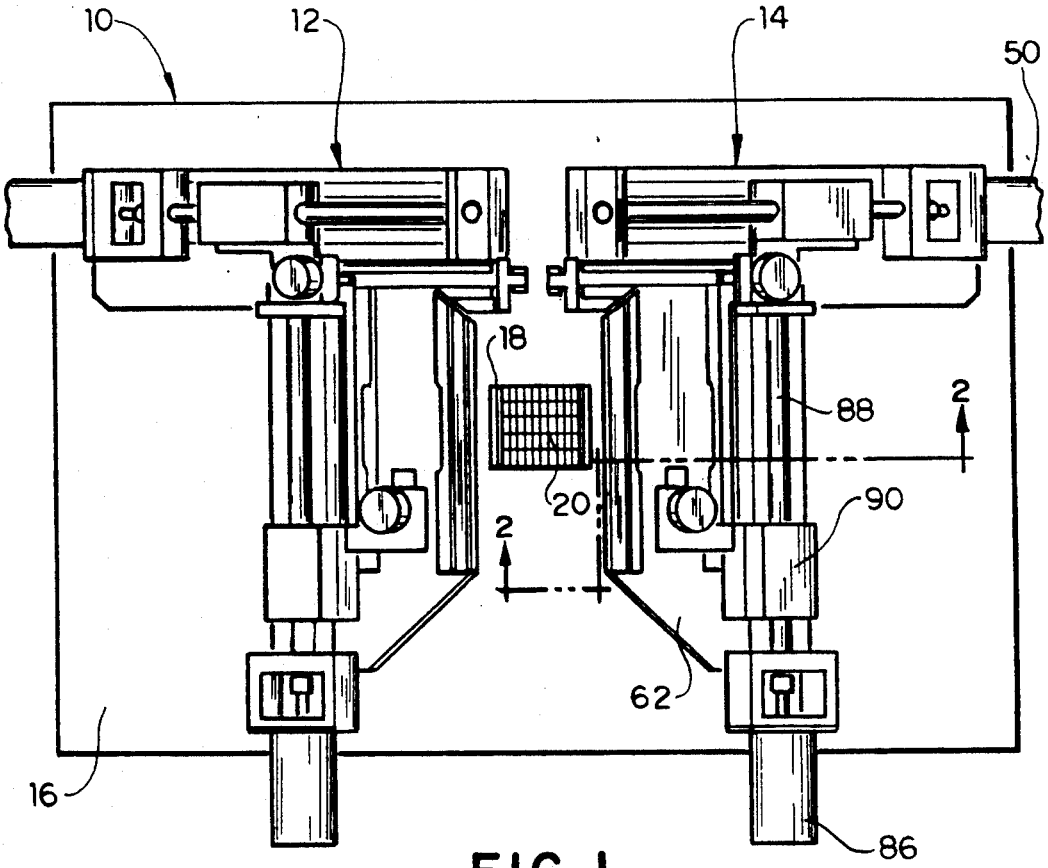
FIG. 1 is a top view of a machine using a pair of substrate breakers as described with plates being fed to the individual breakers from a single magazine.

Breaking machine 10 includes a pair of like, mirror-image substrate breakers 12 and 14 mounted on horizontal support plate 16 to either side of elevated plate holder 18. A stack of square, unbroken ceramic substrate plates is placed in holder 18 with the uppermost plate alternatively delivered to breakers 12 and 14 by vacuum pick and place head 22 shown in FIG. 2. The pick and place head is moved from the plate holder 18 to the breakers 12 and 14 by a conventional air cylinder drive (not illustrated).

The square ceramic plates 20 have a plurality of small rectangular substrate chips 24 arranged along the width and length of the plate in a rectangular grid. A circuit element (not illustrated) is mounted on the inner upper surface of each chip and contact pads (not illustrated) are formed along the opposed long sides of the chip. The lines 26 between adjacent chips are prescribed or weakened, conventionally by forming small laser burn holes in the ceramic body of the plate.

Figure 9:
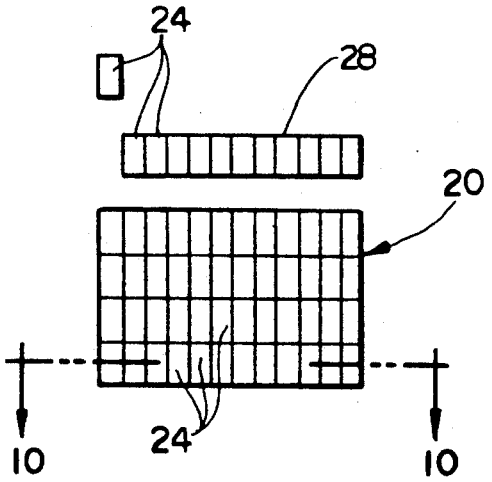
FIG. 9 illustrates a substrate plate with a broken away stick and a chip broken away from the stick.
Figure 10:
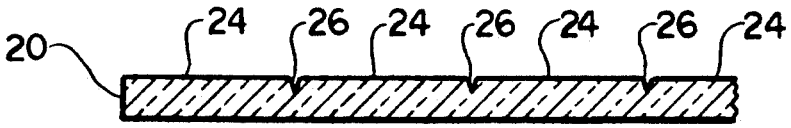
FIG. 10 is an enlarged sectional view taken along line 10—10 of FIG. 9.

The breakers 12 and 14 received square plates 20 and break a row or stick 28 of chips from one end of the plate. FIG. 9 illustrates a plate 20 from which a number of sticks 28 have been broken away. Then, each broken stick 28 is fed longitudinally and a lead chip 24 is broken from the chip. The breaks are accurately formed at the lines 26.

Substrate breaker 14 will now be described in detail, it being understood that breakers 12 and 14 are identical with the exception that they are mirror images of each other. The two breakers operate identically.

Breaker 14 includes a fixed stick assembly 30, a plate assembly 32 hinged to one edge of the stick assembly and a chip assembly 34 hinged to the upper end of the stick assembly 30.

Figure 5:
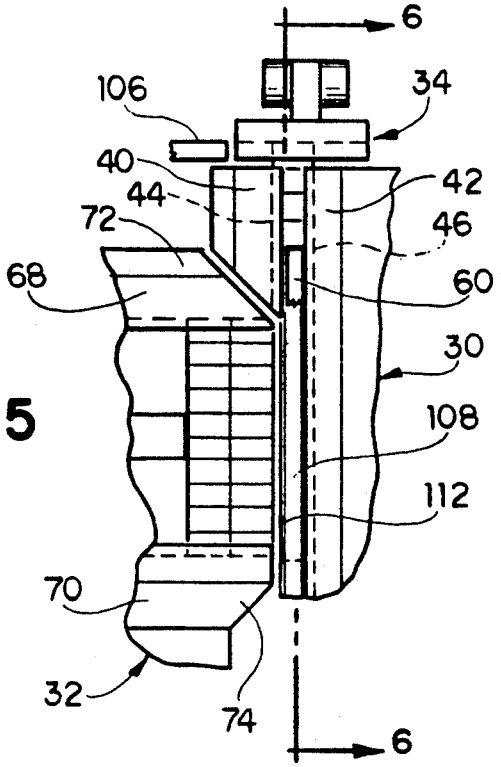
FIG. 5 is a view of a portion of FIG. 4.
Figure 6:
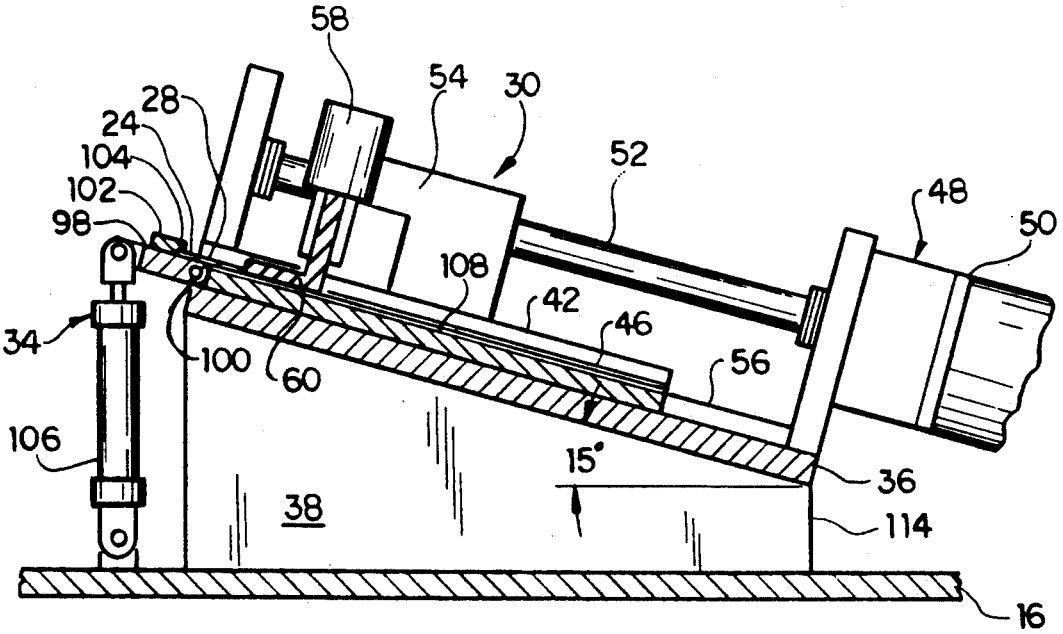
FIG. 6 is a sectional view taken along line 6—6 of FIG. 5.

Fixed stick assembly 30 includes a flat mounting plate 36 supported on plate 16 by legs 38. Plate 36 slopes upwardly toward the chip assembly 34 at a 15-degree angle as shown in FIG. 6. Spaced apart short and long grooved stick guides 40 and 42 are mounted on the upper surface of plate 36 and extend down the plate from the chip assembly. Short guide 40 is located on the side of the assembly adjacent to plate assembly 32. Long guide 42 is spaced away from the plate assembly and extends along the adjacent end of the plate assembly. See FIGS. 4 and 5. A stick groove 44 is formed in the face of guide 40 opposite guide 42. A similar stick groove 46 is formed in the face of guide 42 facing guide 44 and plate assembly 32.

The stick assembly includes a stick feed 48 having a rotary stepping motor 50 and a rotary shaft 52 driven by motor 50. The shaft extends parallel to the guides 40 and 42 and is located on the side of the guides away from the plate assembly 32. Shaft 52 extends through a shaft follower 54 mounted on a linear bearing 56 on plate 32. Rotation of the shaft by motor 50 indexes the follower back and forth along the bearing.

Follower 54 carries an air cylinder 58 having a piston rod joined to stick feed finger 60 located between the guides 40 and 42. Extension of cylinder 58 locates finger 60 in the space between the guides for movement of a stick up toward the chip assembly.

Figure 2:
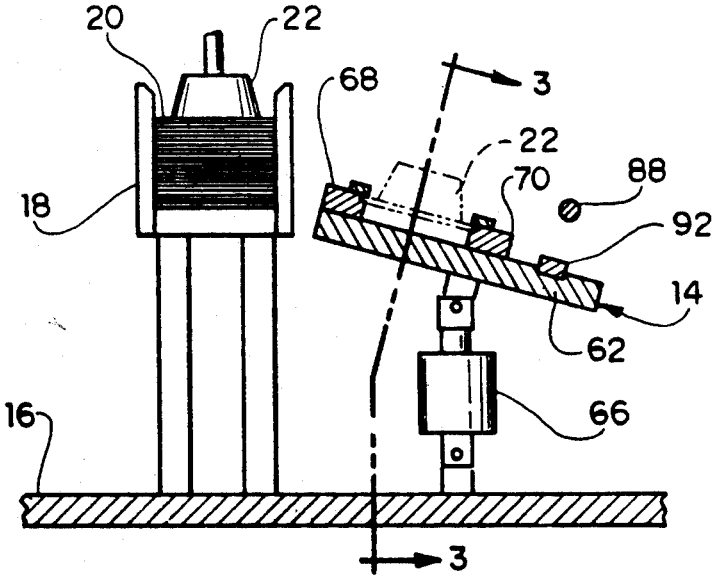
FIG. 2 is a sectional view taken along section line 2—2 of FIG. 1.
Figure 3:
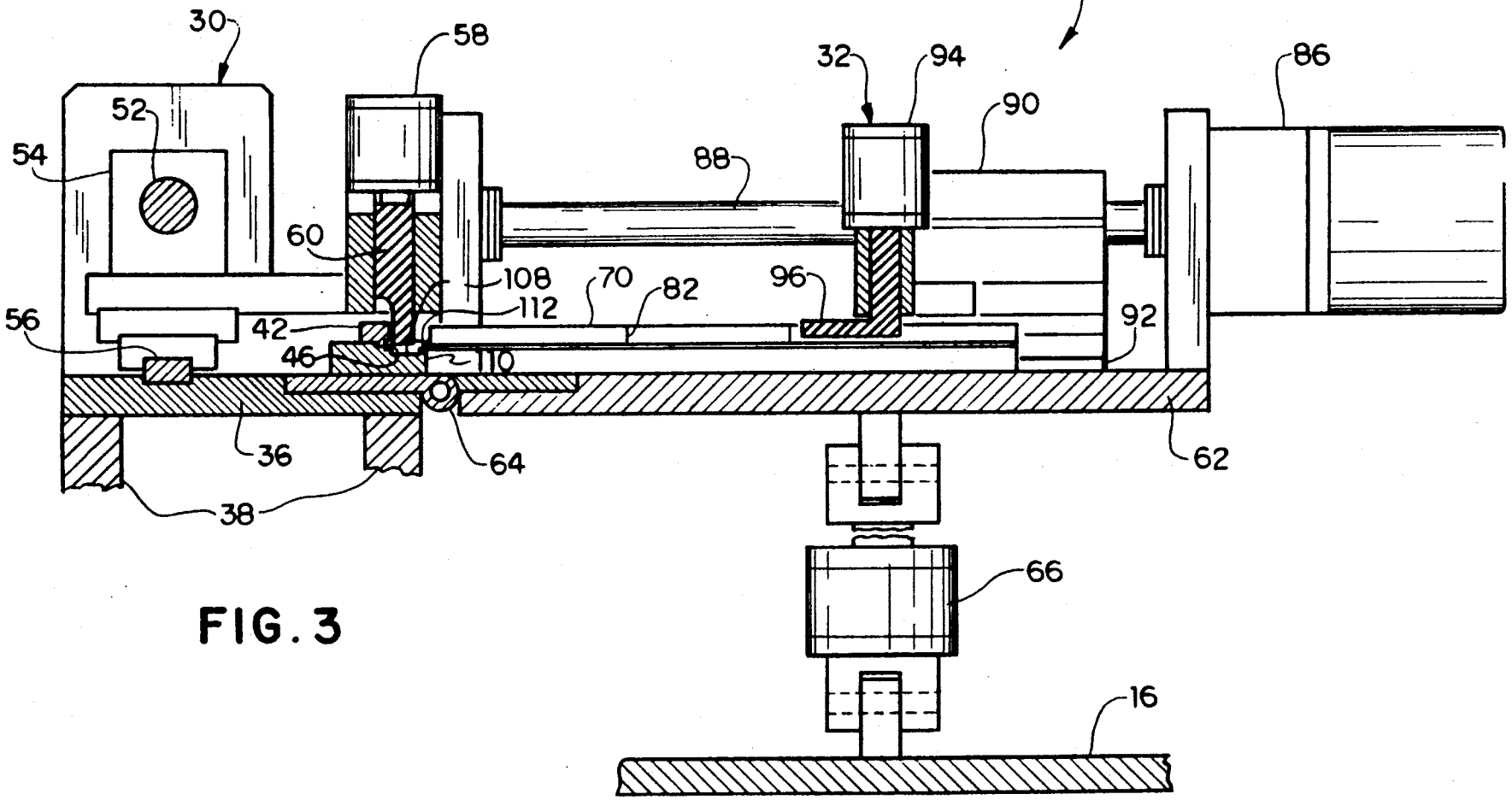
FIG. 3 is a sectional view taken along line 3—3 of FIG. 2.

Plate assembly 32 includes a flat hinge plate 62 joined to the side of mounting plate 36 adjacent the lower end of short stick guide 40 by hinge 64. Plate 62 is joined to the horizontal base plate 16 by an air cylinder 66 located away from hinge 64. When air cylinder 66 is extended as shown in FIG. 2 plate 62 forms an extension of plate 36 and slopes upwardly at an angle of 15 degrees toward the center of machine 12. When cylinder 66 is retracted the plate 62 is rotated down with respect to plate 36. Compare FIGS. 3 and 7.

A pair of spaced grooved guides 68 and 70 are mounted parallel to each other on the top of plate 62 with the downstream end 72 of guide 68 located adjacent the lower end of the stick assembly short guide 40 and the downstream end 74 of guide 70 located opposite the lower end of stick assembly long guide 42. Plate grooves 76 and 78 are formed in the inner edges of guides 68 and 70. Openings 80 and 82 are formed in the tops of the grooves 76 and 78 to permit placement of plates 20 in the grooves.

The plate assembly 32 includes a plate feed 84, similar to stick feed 48, located on the lower or downhill side of plate 62 away from the center of breaking machine 10. Plate feed 84 includes a stepping motor 86, rotary shaft 88, shaft follower 90, linear bearing 92, air cylinder 94 and plate feed finger 96 similar to the corresponding elements of the stick feed 48. The feed finger 96 is located between guides 68 and 70 for moving a plate 20 placed in grooves 76 and 78 at windows 80 and 82 toward the stick assembly 30.

Chip assembly 34 includes a chip support 98 at the top of the breaker 14 connected to the upper end of the stick assembly 30 by hinge 100 located at the upper ends of the two guides 40 and 42. The chip support 98 carries a chip stop 102 on the upper surface thereof to define a chip-receiving groove 104 on the upper surface in position to receive and seat the lead edge of the lead chip of stick 28 as the stick is moved up assembly 30 by finger 60 when the chip assembly is in the raised position of FIG. 6. In this position, the upper surface of support 98 forms an extension of the lower surfaces of grooves 44 and 46.

Figure 8:
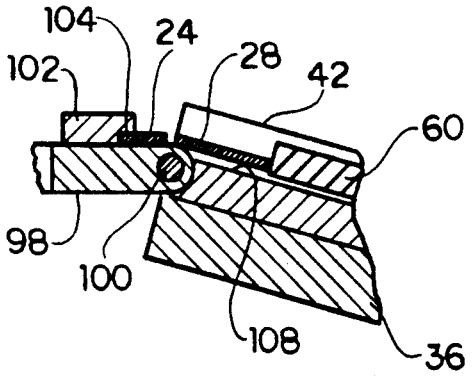

Air cylinder 106 is connected to the end of chip support 98 away from hinge 100 and to support plate 16. When cylinder 106 is extended the chip support is raised and slopes upwardly at an angle of 15 degrees. Retraction of cylinder 106 rotates the chip support down 15 degrees to a horizontal position as shown in FIG. 8 and cleanly breaks the lead chip 24 away from the remainder of the stick 28.

Guide 70 is adjustably mounted on plate 62 to vary the spacing between the two guides 68 and 70 and permit accommodation of different size plates. Likewise, the position of guide 42 relative to guide 40 may be varied to accommodate different width sticks 28.

Figure 7:
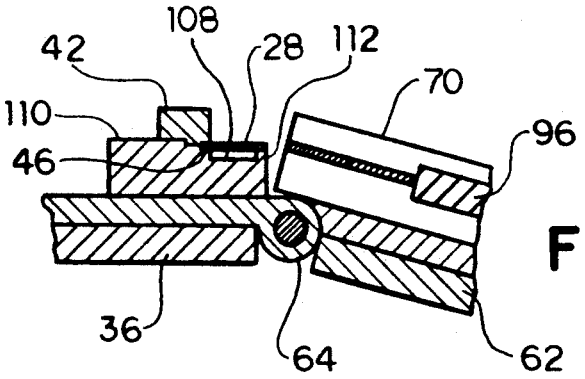
FIGS. 7 and 8 are enlarged views of portions of FIGS. 3 and 6, respectively showing breaking of substrate sticks from plates and chips from sticks.

Guide 42 is mounted on a support block 110 shown in FIG. 7 which, in turn, is mounted on plate 36. The width of block 110 increases at the upper end of the plate assembly and supports the short guide 40. A recess 108 is formed in the upper surface of block 110 between the guides and extends down along the length of the block. Finger 60 extends into the recess. The recess collects ceramic shards and dust from breaking the sticks away from the plates and gravity channels these materials down the 15-degree slope and away from the chip assembly. Stick supporting ridge 112 defines the edge of the recess adjacent the plate assembly 32.

The operation of substrate breaker 14 will now be described. Pick and place transfer head 22 picks up the top plate 20 in plate holder 18, moves the plate over guides 68 and 70 and then lowers the plate down through openings 82 and 84 so that it rests freely on the lower surfaces of plate grooves 76 and 78. These plate grooves, together with grooves 44 and 46 in guides 40 and 42 and the groove 104 in chip assembly 34 have a height slightly greater than the thickness of the edge of the substrate and a depth of approximately 0.050 inch. The individual chips 24 are manufactured with circuitry located more than 0.050 inch inwardly of the edges of the chips in order to assure that the edges of the plates 20, sticks 28 and chips 24 extend freely into and are movable along the various grooves in the substrate breaker. Contact pads may be provided on the edges of the chips but do not prevent free movement of the chips along the grooves.

Figure 4:
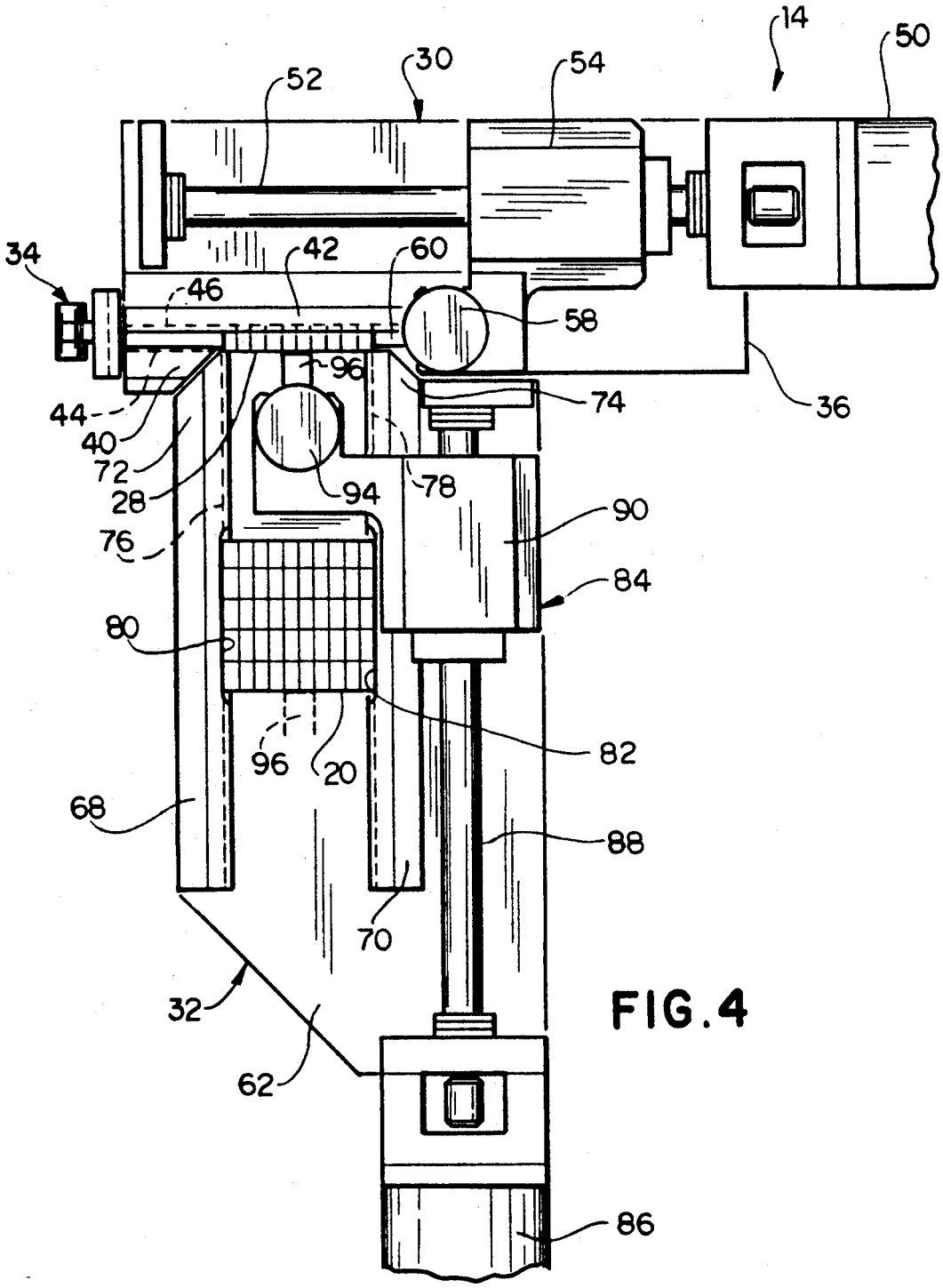
FIG. 4 is a top view of a substrate breaker shown to the right of FIG. 1.

A new plate 20 is positioned in the grooves 76 and 78 after plate feed 84 moves the last stick of the prior-fed plate into the stick assembly 30 and the stick is moved up the stick assembly to the chip breaker 34 where chips are broken from the ends of the stick. FIG. 4 illustrates plate feeder 84 in the fully extended position with finger 96 holding the last stick in place in the stick assembly. After this stick has been fed up the assembly and is confined in the opposed grooves 44 and 46 for further upward feeding and breaking away of the individual chips, air cylinder 94 is retracted to lift feed finger 96 up above the level of the newly fed plate 20. Stepping motor 86 is reversed to rotate shaft 86 sufficiently to retract the shaft follower 90 away from the stick assembly until the elevated feed finger 96 is located behind the plate 20 in a position shown in FIG. 3. Cylinder 94 is then extended to lower the finger 96 directly behind the plate.

The stepping motor 86 is then actuated to rotate shaft 88 and move shaft follower 90, feed finger 96 and plate toward the stick assembly a sufficient distance until the lead edge of the plate is extended beyond the guide ends 72 and 74 over ridge 112 and recess 108 and into groove 46 on guide 42. The bottom of the lead stick rests flush on and is supported by ridge 112. The weakened line 26 at the intersection of the lead and second sticks is located immediately above the ends of the guide ends 72 and 74. The stepping motor 86 is rotated sufficiently that finger 96 snugly holds the plate with the lead stick confined in the stick assembly.

The lead stick is broken from the remainder of plate 20 by retracting cylinder 66 and rotating the entire plate assembly 32 down a few degrees with respect to the fixed stick assembly 30. Downward rotation cleanly breaks the lead stick from the remainder of the plate at the weakened line between the adjacent sticks with the formation of minimum ceramic dust. A neat break is formed with generally perpendicular break edges. The break separates the sticks on either side of the break to allow inevitable debris formed by the break to gravity fall below the level of the stick and plate and down the stick assembly to collect at end 114 away from the chip assembly 34. Finger 60 is located in the lower position of FIG. 4 to support the stick in the assembly 30 during breaking of the stick from the plate.

After the lead stick has been broken from plate 20 and before cylinder 66 is extended motor 50 is rotated in the forward direction to move the finger 60 and the stick up the stick assembly. During this operation the forward edge of the stick is confined in groove 46. The freshly broken edge of the stick is maintained in place for feeding into groove 44 by the adjacent freshly broken edge of the remainder of the plate. The separation at the broken edges permits feeding of the broken away stick. Initial upward movement of finger 60 moves the lead end of the stick into groove 44 so that the grooves 44 and 46 align the stick and assure proper feeding of the stick to the chip breaker 34.

Motor 50 is rotated sufficiently to move finger 60 and the stick upwardly until the lead edge of the lead chip 24 is snugly seated in groove 104 of the chip breaker as shown in FIG. 6. When in this position, the weakened line extending across the stick at the junction between the lead chip and the second lead chip is located immediately at the ends of the two guides 40 and 42 supporting the stick. Air cylinder 106 is then retracted to rotate the chip support 98 and stop 102 down from the position of FIG. 6 to the position of FIG. 8, thereby breaking the lead chip 24 from the stick. A neat open break is formed at the weakened line between the adjacent chips with minimum debris. This break occurs at the top of the machine so that debris is gravity flowed down from the chip break tooling. Breaking of the lead chip from the stick locates the chip in a horizontal plane freely resting on the top surface of the chip support 98. A feed blade 106 shown in FIG. 5 is then moved toward the breaker to engage the end of the freed chip and move the chip laterally away from the chip assembly and the stick assembly to a testing station (not illustrated). In this station the dimensions and other properties of the chip are tested. Chips that fail the tests are discarded. Chips that pass the tests are fed to another station for a subsequent operation. The chips are subsequently mounted on a circuit element, conventionally a circuit board.

When all of the chips have been broken away from the stick, feed finger 60 is repositioned at the bottom of the stick assembly in order to prevent the next stick from freely sliding down the assembly. Cylinder 66 is extended. Motor 86 is then actuated to feed the next stick on the plate into the stick assembly. This newly fed stick is broken from the plate as described and is then fed up the stick assembly to the chip breaker for breaking of the individual chips from the stick as described.

The breaking of the sticks from the plate and the breaking of the individual chips from the sticks continues until the last stick in the plate is fed to the stick assembly as shown in FIG. 4. Feed finger 96 holds this stick in the assembly during initial upward feeding by finger 60 to assure piloting of the stick into the groove 44. After the last stick is fed to the stick assembly 30 a new plate 20 is positioned in grooves 76 and 78 as shown in FIG. 4 and the cycle of operation is repeated.

During breaking of chips from plate 20 the plate is fitted in grooves 76 and 78 and tilted up 15 degrees toward from the chip assembly 34. The edge of the plate nearest the chip assembly is located above the edge away from the chip assembly and the lead edge of the plate slopes upwardly at a 15-degree angle so that the stick broken from the plate also extends upwardly at a 15-degree angle is in position to be fed up the stick assembly to the chip assembly 34 at the top of the chip breaker. The location of the chip breaker at the top of the machine assures that debris formed during the breaking of the sticks falls down away from the chip assembly to reduce wear caused by movement of the abrasive ceramic plates, sticks and debris along the grooves and through the breaker. Additionally, the breaking operations which remove sticks from the plate and chips from the sticks are performed by pivoting the supported sticks or chips relative to the supported plates or sticks about axes located a distance below the break edges to assure that openings are formed at the break edges. The openings facilitate gravity removal of inevitable ceramic dust caused by breaking. The dust formed during breaking of the sticks from the plates gravity falls down from grooves 76 and 78 and down the stick assembly. The dust formed during breaking of the chips from the sticks falls down from grooves 44 and 46 and may be removed by an air blast or a vacuum collector, as required.

During breaking the upwardly inclined plate 20 is moved along a plate path toward the stick breaker. Upwardly inclined sticks 28 broken from the plate are moved up along a 15 degree second stick path extending perpendicular to the plate path.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

What we claim as our invention is:

1. A substrate breaker comprising:

a) elevated chip breaker means for breaking a lead chip from a stick of chips;

b) stick breaker means located below the chip breaker means for breaking a stick of chips from a substrate plate;

c) a stick feed path extending upwardly from the stick breaker means to the chip breaker means; and d) stick feed means for moving a stick of chips up the path.

2. A substrate breaker as in claim 1 wherein the chip breaker means includes a chip holder, first holding means for the second lead chip in the stick, and a rotary connection between the chip holder and the first holding means.

3. A substrate breaker as in claim 2 wherein the stick breaker means includes a stick holder, second holding means for the second lead stick in the substrate plate, and a rotary connection between the stick holder and the second holding means.

4. A substrate breaker as in claim 3 wherein each rotary connection is located below the chip holder.

5. A substrate breaker as in claim 3 including plate feed means for moving a plate to the stick breaker means.

6. A substrate breaker as in claim 5 wherein said stick feed path includes a pair of spaced parallel grooves engagable with side edges of a stick, the upper ends of said grooves forming said first holding means, said stick holder comprising a downward extension of one of said grooves.

7. A substrate breaker as in claim 3 wherein the stick feed path extends upwardly at an acute angle.

8. A substrate breaker as in claim 1 wherein the stick feed path extends upwardly at an acute angle.

9. A substrate breaker including a stick assembly having an upwardly extending stick feed path with opposed stick grooves for receiving the edges of a stick; a chip breaker at the upper end of the feed path; a stick breaker at the lower end of the feed path having a plate groove for receiving a lead edge of a stick, the plate groove forming a downward extension of one of the path grooves; a plate assembly including a plate feed path extending toward the stick breaker and a pair of opposed plate feed grooves for receiving the edges of a ceramic chip plate, a plate feeder for moving a plate along the plate feed path to position the lead edge of a stick in the plate groove; a stick feeder for engaging the end of a stick near the stick breaker and moving such stick into and along the stick feed path to position successive lead chips in the chip breaker.

10. A substrate breaker as in claim 9 wherein the chip breaker includes a chip holder, a rotary connection joining the chip holder to the stick assembly and a drive for rotating the chip breaker relative to the stick assembly.

11. A substrate breaker as in claim 10 including a rotary connection joining the plate assembly to the stick assembly and a drive for rotating the plate assembly relative to the stick assembly.

12. A substrate breaker as in claim 11 wherein the stick feed path extends upwardly at an angle of approximately 15 degrees to the horizontal.

13. A substrate breaker as in claim 12 wherein each rotary includes a hinge having an axis located below the adjacent path.

14. A substrate breaker as in claim 12 wherein one plate feed groove is located above the other plate feed groove.

15. A substrate breaker as in claim 14 wherein said plate feed grooves extend generally perpendicular to said stick grooves.

16. The method of breaking a substrate plate into individual substrate chips comprising the steps of:

a) successively breaking lead sticks from the plate, each stick including an integral row of substrate chips;

b) allowing plate debris formed by breaking to gravity fall away from the sticks;

c) moving each lead stick upwardly from the remainder of the substrate plate; and d) breaking individual chips from an elevated end of each stick.

17. The method of claim 16 including the step of moving the stick upwardly along its length at an acute angle.

18. The method of claim 16 including the steps of maintaining the plate tilted up at an acute angle during step a) and maintaining each lead stick tilted up at the same acute angle during steps c) and d).

19. The method of claim 16 including the step of holding the lead stick on the plate fixed and rotating the remainder of the plate to break the lead stick from the remainder of the plate.

20. The method of claim 16 including the step of separating the stick from the remainder of the plate immediately after breaking of the stick from the remainder of the plate.

* * * * *

UNITED STATES PATENT AND TRADEMARK OFFICE

CERTIFICATE OF CORRECTION

PATENT NO. : 5,133,491

DATED : July 28, 1992

INVENTOR(S) : Thomas R. Correll et al

It is certified that error appears in the above-identified patent and that said Letters Patent is hereby corrected as shown below:

Column 2, line 57, after "operation", delete --to--.

Column 8, line 49: after "rotary", insert --connection--.

Signed and Sealed this

Tenth Day of August, 1993

*Attest:*

Michael K. Kirk

MICHAEL K. KIRK

*Attesting Officer*

*Acting Commissioner of Patents and Trademarks*